US005136987A

United States Patent [19]

Schechter et al.

[11] Patent Number: 5,136,987

[45] Date of Patent: Aug. 11, 1992

[54] VARIABLE DISPLACEMENT AND COMPRESSION RATIO PISTON ENGINE

[75] Inventors: Michael M. Schechter, Southfield; Aladar O. Simko, Dearborn Heights; Michael B. Levin, Birmingham, all of Mich.

[73] Assignee: Ford Motor Company, Dearborn, Mich.

[21] Appl. No.: 720,074

[22] Filed: Jun. 24, 1991

[51] Int. Cl.[5] ..... F02B 75/12

[52] U.S. Cl. ..... 123/48 B; 123/78 E

[58] Field of Search ..... 123/48 R, 48 B, 78 E, 123/197.1

[56] References Cited

U.S. PATENT DOCUMENTS

| | | | |
|---|---|---|---|
| 1,112,832 | 10/1914 | Pierce . | |
| 1,189,312 | 7/1916 | Tibbels . | |
| 1,372,644 | 3/1921 | Collins . | |
| 2,653,484 | 9/1953 | Zecher . | |
| 2,822,791 | 2/1958 | Biermann | 123/48 B |
| 2,873,611 | 2/1959 | Biermann . | |
| 2,909,163 | 10/1959 | Biermann . | |
| 4,131,094 | 12/1978 | Crise | 123/78 E |
| 4,538,557 | 9/1985 | Kleiner et al. | 123/78 E |

FOREIGN PATENT DOCUMENTS

| | | | |
|---|---|---|---|
| 207108 | 12/1906 | Fed. Rep. of Germany | 123/48 B |
| 720427 | 2/1932 | France | 123/48 B |

*Primary Examiner*—David A. Okonsky

*Attorney, Agent, or Firm*—Jerome R. Drouillard; Roger L. May

[57] ABSTRACT

The present invention contemplates a mechanically simply constructed mechanism located internally of a piston engine for adjustably changing the stroke of a piston over a predetermined range in response to a variety of operating control parameters. The adjustable stroke changing mechanism provides an optimum compression ratio at each change in piston stroke and over the entire range of piston stroke provided which may be varied from one piston engine to another of different performance characteristics without requiring a major change in design of the stroke changing mechanism. The stroke changing mechanism includes a swing plate pivotally fixed to the engine block at one end and placed intermediate the piston connection rod and respective crankshaft pin at its other end, each of which are affixed to and translate within the swing plate as the piston is driven to reciprocate within a piston cylinder. An adjustment link is pivotally connected to the engine block at one end and to the connecting rod at its other end and at the swing plate. The adjustment link is hydraulically controlled and actuable to vary in length and thereby change the stroke, and concurrently the compression ratio of the piston.

16 Claims, 3 Drawing Sheets

VARIABLE DISPLACEMENT AND COMPRESSION RATIO PISTON ENGINE

TECHNICAL FIELD

This invention relates to piston engines and apparatus for automatically varying piston stroke and compression ratio, and is particularly related to internal combustion engines including apparatus for automatically varying the stroke of the piston during operation of the engine responsive to changes in operating conditions or performance demands.

BACKGROUND ART

The conventional reciprocating piston-type internal combustion engine commonly used in automotive vehicles can be significantly improved if part load throttling and friction losses are reduced. In other words, conventional engines of this type are designed such to give optimum performance at full load, wide open throttle. At less than wide open throttle, and particularly at the lower speeds, the fuel in the combustion chamber of any fixed stroke engine will be less dense. Consequently, its burning efficiency will be reduced. Further, the friction losses in a reciprocating piston-type engine remain relatively constant regardless of speed. Consequently, at the lower speeds, the friction losses are a greater proportion of the work being expended to require the performance output. Lower throttling and friction losses will provide reduced fuel consumption, i.e. greater fuel efficiency. Further, the resulting improvement in fuel efficiency can be additionally enhanced by concurrent optimization of the compression ratio for each engine displacement.

Variable stroke piston engines are known, such as shown for example in the following U.S. patents: U.S. Pat. Nos. 1,112,832; 1,189,312; 1,372,644; 2,653,484; 2,873,611; 2,909,163; 4,131,094; and 4,538,557.

In certain of the systems, for example, as shown in U.S. Pat. No. 2,909,163, an articulated linkage is provided between the crankshaft pin and the piston connecting rod that allows for varying the piston stroke while maintaining a constant piston clearance with the cylinder head (as is useful in compressor applications), or varying the piston clearance with each change in piston stroke. Adjustment of the stroke is effected manually on the exterior of the engine block or frame.

Manual adjustment is common to the remaining aforementioned patents with the exception of U.S. Pat. No. 4,131,094 wherein there is shown a system for automatically adjusting the piston stroke in accordance with different density of the fuel-air charges to be inducted into the combustion chamber.

SUMMARY OF THE INVENTION

The present invention contemplates a mechanically simply constructed mechanism located internally of a piston engine for adjustably changing the stroke of a piston over a predetermined range.

The invention further contemplates such an adjustable stroke changing mechanism which by design provides the optimum compression ratio at each change in piston stroke and over the entire range of piston stroke provided, and wherein modifications of the relationship of the compression ratio to piston stroke may be varied from one piston engine to another of different performance characteristics without requiring a major change in design of the stroke changing mechanism.

The invention further contemplates such a stroke changing mechanism which is particularly suitable for high production, high performance internal combustion engines including automotive engine applications.

The invention further contemplates such a stroke changing mechanism which is constructed completely internally of the engine and capable of automatic control as determined by the engine control system and in response to a variety of operating control parameters.

The invention further contemplates an adjustment means for the stroke changing mechanism which includes a hydraulic cylinder under hydraulic control utilizing the engine fluid system as a source of hydraulic fluid and utilizing torque pulses within such system during operation of the engine to pump fluid through the adjustment mechanism.

The invention still further contemplates a control system as above described which includes a sensor installed in the hydraulic cylinder which provides a feedback signal for monitoring the position of the hydraulic cylinder piston.

The invention further contemplates a piston stroke adjusting mechanism wherein the motion of the piston in the above-mentioned hydraulic cylinder is accomplished by permitting selective fluid flow from one hydraulic chamber of the cylinder to another, taking advantage of intermittent hydraulic pressure pulses in the two hydraulic chambers.

More specifically, the invention includes a variable displacement internal combustion engine comprising an engine block having a crank axis and a cylinder bore lying in a plane generally perpendicular to the crank axis. A piston reciprocates within the cylinder bore. A crankshaft is supported by the engine block and rotatable about the crank axis and includes a crank pin radially spaced from said crank axis. An elongated connecting rod has a first end pivotably attached to the piston and a second end spaced therefrom and movable along an arcuate path lying in said plane. A lever is provided having a fixed end pivotably attached to the engine block and a free end movable within said plane. The lever cooperates with the connecting rod second end to permit relative rotation and limited translation along a first path and cooperates with the crank pin to permit relative rotation and limited translation along a second path. A link is provided having a fixed end pivotably connected to the engine block and a free end pivotably connected to the connecting rod second end. Finally, there is provided an adjustment means for adjusting the length of the link relative to the lever to vary the reciprocal stroke of the piston in order to vary engine displacement.

The adjustment means, in one embodiment of the invention, includes a hydraulic cylinder and an internal reciprocating piston with a stem portion of the piston being integral with the adjusting link and defining a hydraulic chamber on each side of the piston. Selective oil flow from one hydraulic chamber to the other is accomplished through one of two hydraulic passages, each comprising an activatable valve and a check valve. Means are provided to open and close each activatable valve. The opening of one activatable valve while the second is closed causes oil to flow from the first hydraulic chamber to the second hydraulic chamber. Opening of the second activatable valve while the first is closed causes the oil to flow from the second hydraulic chamber to the first. Two additional check valves may be provided to connect the hydraulic passages to an outside source of oil to compensate for differences in volume displacement in the two hydraulic chambers and to replenish oil that may have leaked out of the system.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

As mentioned above, this invention in one preferred form is particularly directed to an internal combustion engine with continuously variable displacement in which the compression ratio is also varied concurrently with change in displacement to assure the best combination of the two parameters for each engine operating condition.

Figure 1:
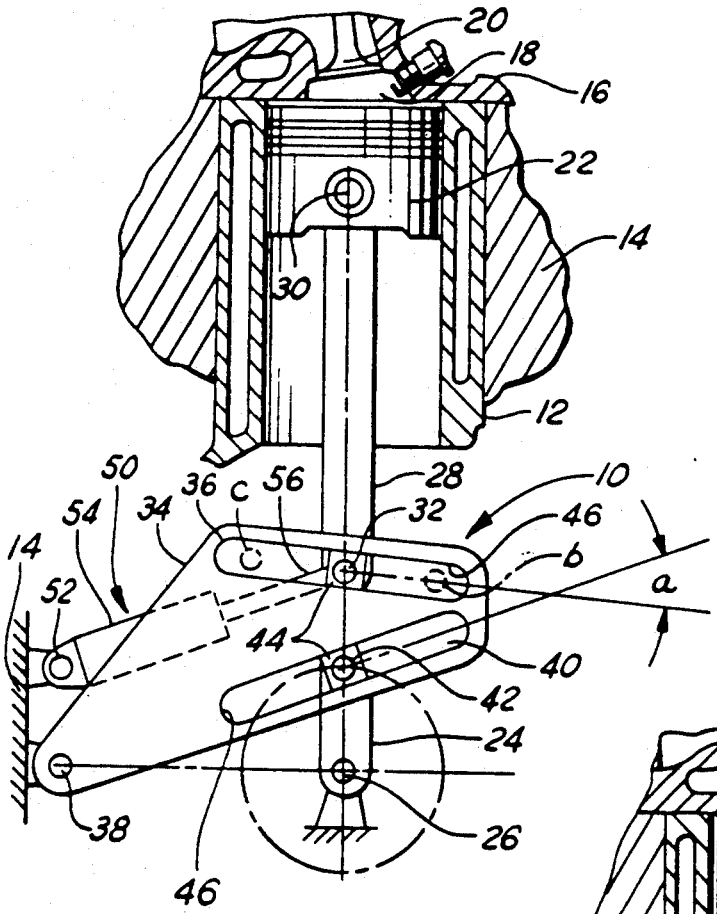
FIG. 1 is a schematic diagram of the piston stroke changing mechanism in accordance with the present invention as applied to a piston engine having a single reciprocating piston and showing the piston at top dead-center position.

FIG. 1 shows a schematic diagram of such a mechanism which performs simultaneous change of displacement and compression ratio during engine operation.

For illustrative purposes, only a single piston and piston cylinder assembly is shown. The assembly, generally designated 10, includes a piston cylinder 12 within an engine block 14 and a cylinder head 16 secured to the engine block at the top of the cylinder and providing a combustion chamber 18 between the valve head 20 and the top of a piston 22. Piston 22 reciprocates within the cylinder 12 as controlled by the speed of the crankshaft 24 which is supported by the engine block 14 and revolves about a crank axis 26.

Piston 22 is connected to the crankshaft 24 by means of an elongate connecting rod 28 having a first end pivotally attached to the piston via a cylindrical piston pin 30 as in conventional construction. At its opposite end, or second end, the connecting rod is pivotally connected by means of a pin 32 to a lever or swing plate 34 within a slot 36 which defines a first path. The swing plate 34 is supported by the engine block 14 at a pivot pin 38.

Swing plate 34 includes a second slot 40, defining a second path, within which the crank pin 42 of crankshaft 24 is pivotally secured.

Within each slot 36,40 of the swing plate there is provided a slide element 44 having sides which are in constant sliding engagement with the internal walls 46 defining each slot. Pins 32,42 extend through a respective slide element. As illustrated, each slot 36,40 is linear and disposed at an angle a relative to one another.

As noted below, varying the angle a will vary the rate of change of compression ratio relative to a change in piston stroke. Further, at least the first slot 36 need not be linear. However, if arcuately shaped, an annular rotary slide wheel would be substituted for the slide block 44. Thus, various swing plate slot configuration can be substituted for that shown dependent upon the piston stroke-to-compression ratio characteristics desired.

The assembly 10 further includes an adjustment link, generally designated 50, which is pivotally affixed to the engine block 14 at one end via pin 52 and pivotally connected to the connecting rod 28 at its other end via pin 32.

Adjustment link 50 basically comprises a fixed cylinder 54 and an adjustably reciprocable stem portion 56. The cylinder 54 is fixed to the engine block via pin 52. The stem portion 56 is integral with a hydraulically actuable reciprocable piston (not shown in FIGS. 1 and 2) within the cylinder 54.

As explained in detail below, the stroke of the piston 22 is varied by hydraulically adjusting the length of the stem portion 56 such that the connecting rod, at top dead center position as shown in FIG. 1 will reside within slot 36 somewhere between the position shown in solid line and position b shown in phantom line. As the pin 32 and the slide element 44 move to the right toward the position b, the length of the arc described by the pin 32 about the pin 52 increases. This increases the stroke of the piston 22. At bottom dead center as shown in FIG. 2 it will be seen that the connecting rod second end has slid from its TDC position shown in FIG. 1 to the point c shown in solid line in FIG. 2 and in phantom line in FIG. 1.

The adjustment link 50 is shown in detail and at various stages of operation in FIGS. 3-6. Looking at FIG. 3, for example, the stem portion 56 includes an integral piston 58 sealingly and slidably engaging the internal wall 60 of cylinder 54. A first hydraulic chamber 62 is provided on one side of piston 58 and a second hydraulic chamber 64 is provided on the other side of piston 58. A pair of hydraulic passages 66,68 are provided for transferring fluid from one chamber to the other. One such hydraulic passage 66 includes an activatable valve member 70, preferably a solenoid valve, located at the inner end of cylinder 54 and a spring biased normally closed ball-type check valve 72 at the other end thereof. The other hydraulic passage 68 includes an activatable valve 74, again preferably a solenoid valve, at the outer end of cylinder 54 and a spring biased normally closed ball-type check valve 76 at the inner end of the cylinder 54. The respective check valves 72,76 are oriented such that no fluid flow is permitted in a direction from the cylinder chambers 64,62, respectively. Only fluid flow from the opposite direction and of sufficient pressure to unseat the ball valve is permitted to flow to each respective chamber 64,62.

Figure 3:
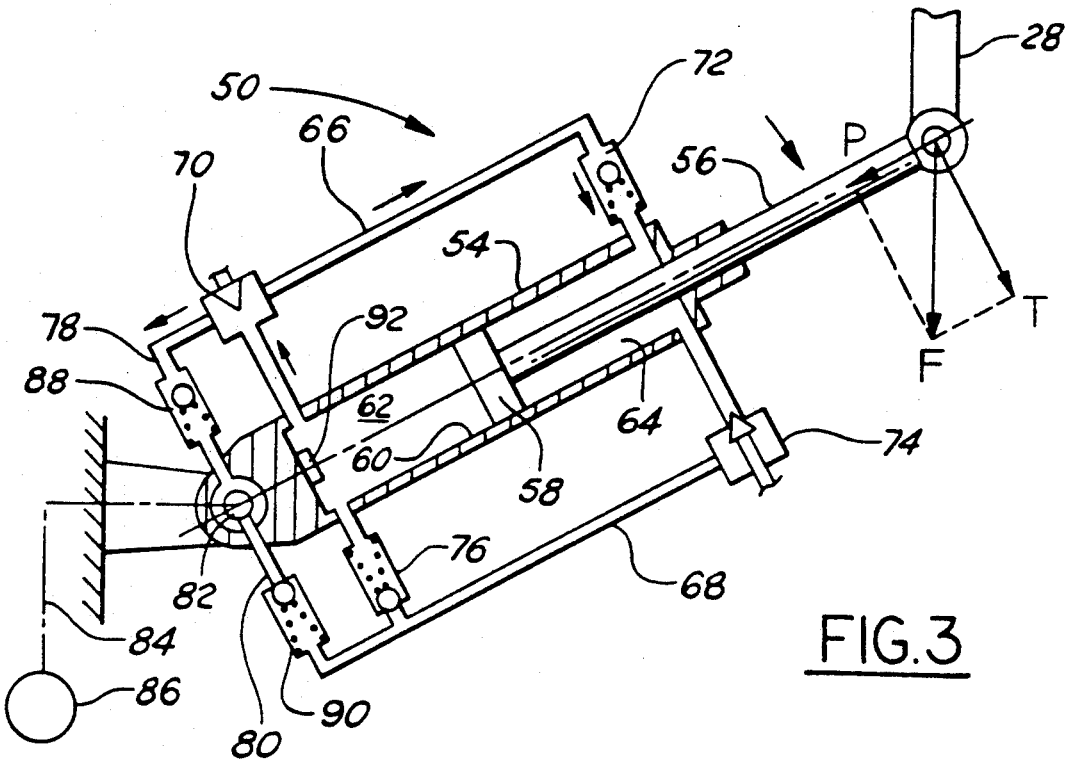
FIG. 3 is a partially schematic view of the hydraulic adjustment member for adjusting the position of the connecting rod on the swing plate in accordance with the present invention and showing a condition in which the piston stroke is shortened and engine displacement reduced.

Each fluid passage 66,68 also is hydraulically coupled with fluid lines 78,80, respectively, which extend from a common fluid reservoir 82 which in turn is hydraulically coupled via line 84 to a sump 86 as shown in phantom line in FIG. 3 only. Preferably, the sump 86 is the source of lubricating oil for the engine and it may include a conventional hydraulic pump or, in addition, an auxiliary hydraulic pump for supplying the lubricating oil under pressure to the adjustment link 50. Each fluid line 78,80 includes a normally closed spring biased ball-type check valve 88,90, respectively, identical to those 72,76 earlier described. Check valve 90 is normally closed to fluid flowing from reservoir 82 whereas check valve 88 is normally closed to any fluid flowing to reservoir 82. The purpose of these connections is to compensate for the difference in the piston displacements in chambers 62 and 64 and to make up for leakage.

Figure 2:
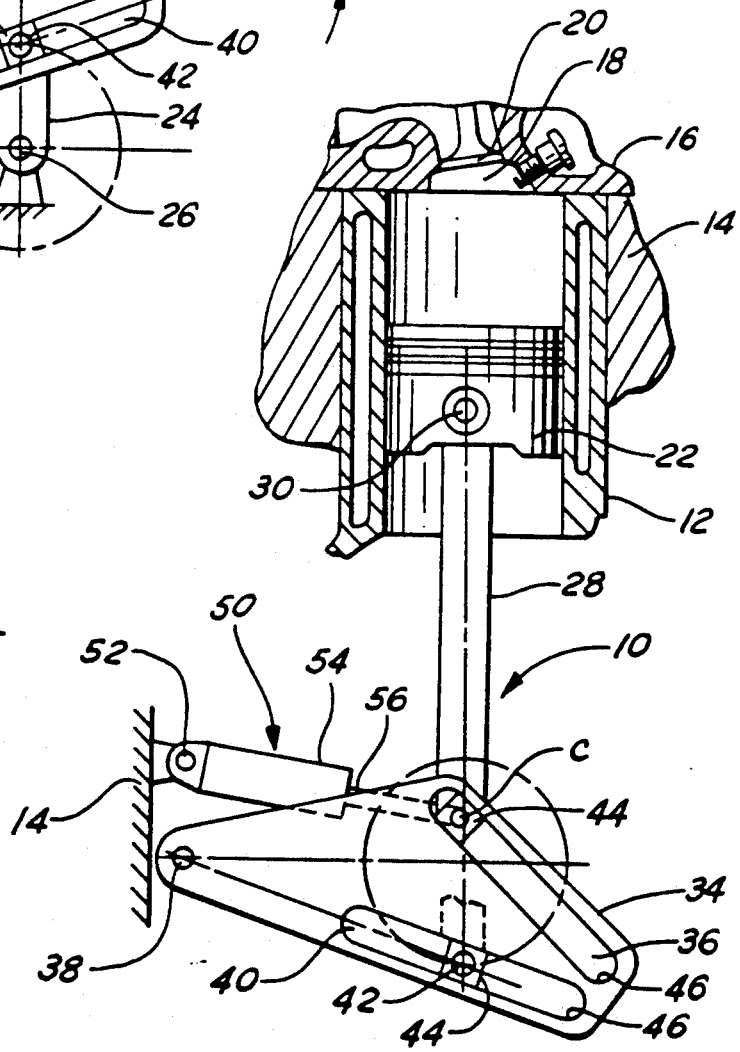
FIG. 2 is a schematic diagram similar to FIG. 1 showing the piston at bottom dead-center position and at the same fixed stroke length as shown in FIG. 1.

In operation, looking at FIGS. 1 and 2 initially, the pressure force generated in the engine cylinder 12 is transmitted to the crankshaft 24 through the piston 22, connecting rod 28, and swing plate 34.

The connecting rod 28 being connected to the swing plate 34 by means of slide 44 is controlled by hydraulic control cylinder 54. Changing the position of the slide 44 in the slot 36 varies the stroke of the piston 22. The shape of the slot, i.e. linear versus arcuate, and the angle of the slot relative to slot 40 determines the compression ratio which can be optimized for each engine displacement.

The actions of the hydraulic cylinder 54 are performed under the control of the engine control system. The necessary hydraulic power can be supplied by a conventional hydraulic pump as mentioned above. It can also be supplied by the forces coming from the engine piston 22 and connecting rod 28 without the need for a hydraulic pump.

The hydraulic piston 58 being integrally connected to the stem portion 56 receives an axial force "P" from the connecting rod 28. When both valves 70 and 74 are closed, no flow of oil is possible between the chambers 62 and 64. Oil in both chambers is trapped there, and the piston 58 remains in fixed position in the cylinder 54. The installation of the check valves 72 and 76 is such that, when the valve 70 is open, oil can flow from the chamber 62 to the chamber 64 but not back; and when the valve 74 is open, it can flow from the chamber 64 to 62 but not back.

The basic concept takes advantage of the fact that the overall geometry of the mechanism is such that the axial force "P" transmitted from the connecting rod 28 to the stem portion 56 changes direction during each engine piston stroke. When the cylinder 54 is in the upper part of its swinging motion, as shown in FIGS. 3 and 5, a downward connecting rod force "F" generates a component force "P" which strives to push the stem portion 56 with the piston 58 into the cylinder 54, thus compressing and rising the pressure of the oil in the chamber 62. When the cylinder 54 is in the lower part of its swinging motion, as shown in FIGS. 4 and 6, the same downward force "F" would generate an oppositely directed force "P" which strives to pull the stem portion 56 with the piston 58 out of the cylinder 54, thus compressing the oil in the chamber 64.

Figure 4:
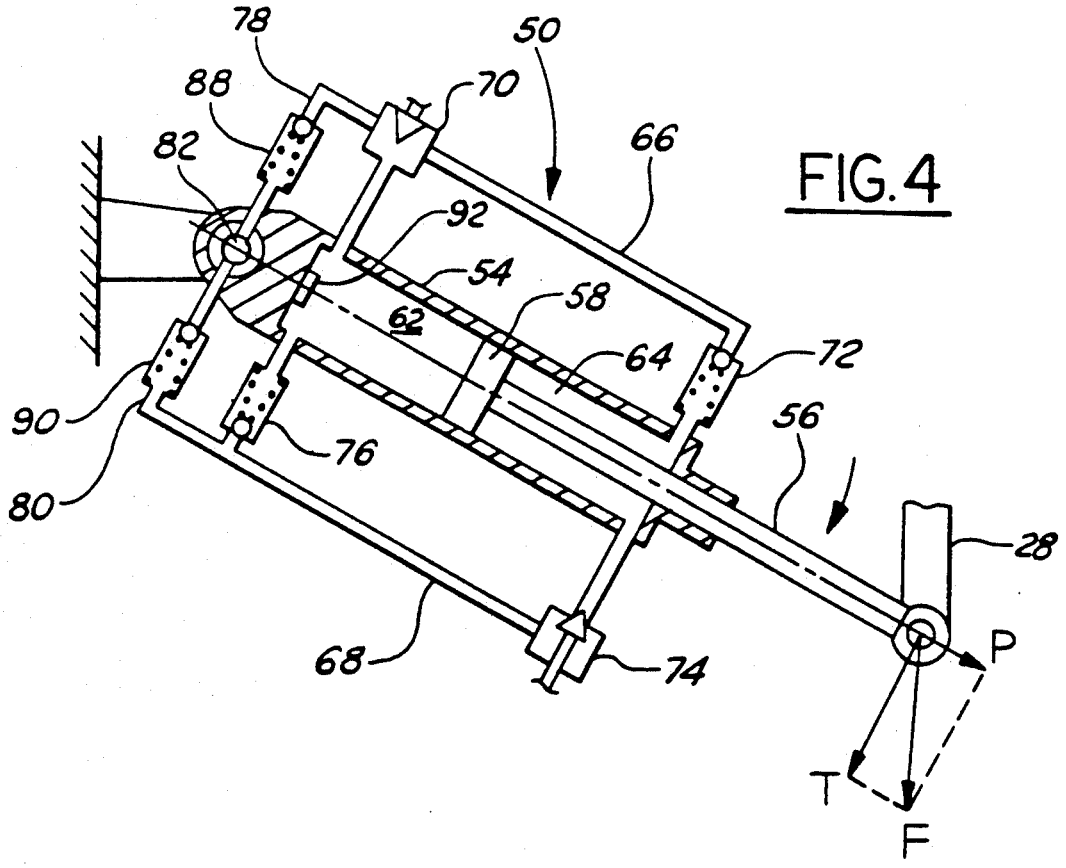
FIG. 4 is a view similar to FIG. 3 showing the same operating condition at a different point in the stroke of the engine.
Figure 5:
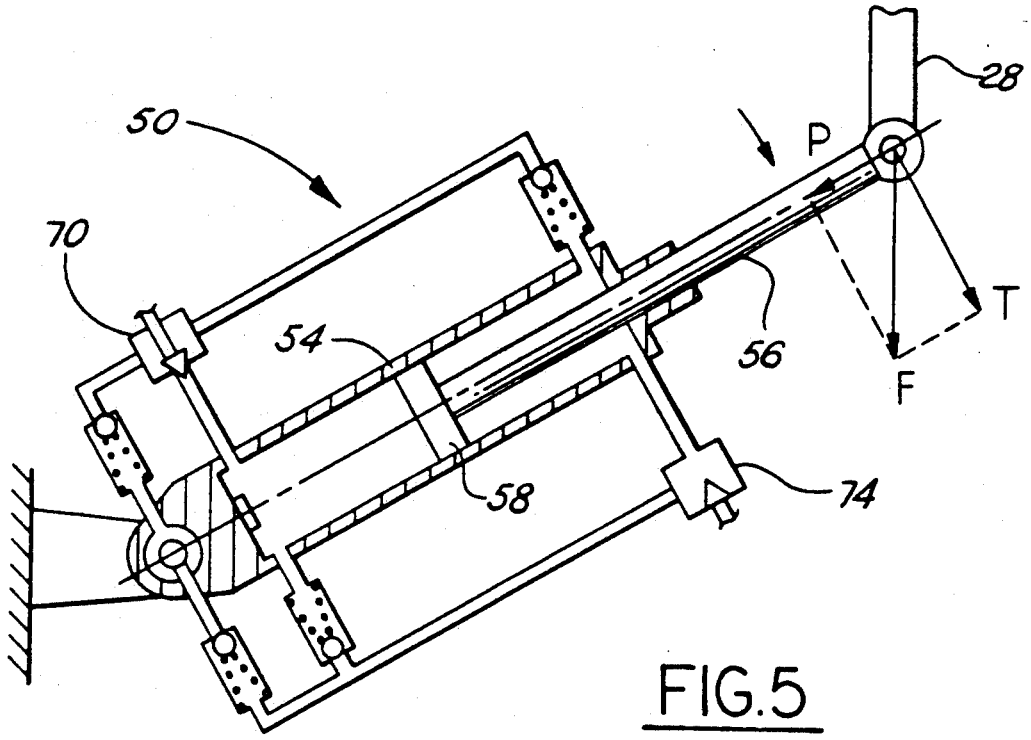
FIG. 5 is a view similar to FIG. 3 and illustrating the control mechanism in a state allowing the piston stroke to be increased thereby increasing engine displacement.

FIGS. 3 and 4 illustrate what happens when the valve 70 is open and the valve 74 remains closed. When the cylinder 54 is in the upper part of its downward swinging motion, as shown in FIG. 3, oil pressure in the chamber 62 is higher than in the chamber 64, and the pressure differential opens the check valve 72. Force "P" pushes the piston 58 to the left, displacing the oil from the chamber 62 to chamber 64. Since the volume displaced from the chamber 62 is larger than the volume change in the chamber 64, some of the oil is displaced through the check valve 88 into the outside system 82,86.

When the cylinder 54 is in the lower part of its downward swinging motion, as shown in FIG. 4, oil pressure in the chamber 64 is higher than in the chamber 62, and the check valve 72 closes. Force "P" strives to move the piston 58 to the right, but the oil trapped in the chamber 64 prevents this motion. Therefore, as long as the valve 70 remains open, the piston 58 moves to the left and only to the left. As a result, the stroke of the engine piston shortens, and the engine displacement is reduced. Closing of the valve 70 stops the change of displacement. A sensor 92 installed in the bottom of the cylinder 54 monitors the distance to the piston 58, which is a measure of the engine displacement, and provides the control system with a feedback signal.

Figure 6:
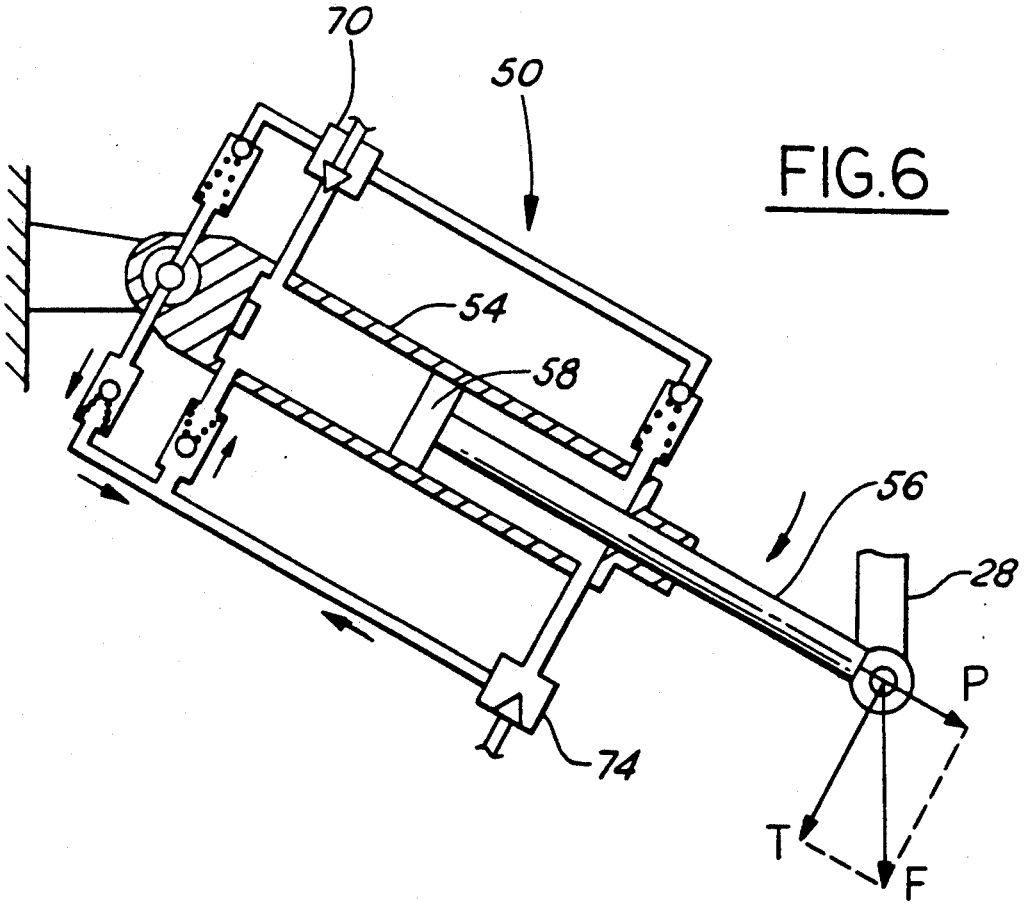
FIG. 6 is a view similar to FIG. 5 at a different point in the stroke of the piston.

FIGS. 5 and 6 illustrate what happens when the valve 74 is open and the valve 70 remains closed. The process is very similar to the one described above, except that this time the piston 58 moves to the right, thus increasing the engine displacement.

It should be understood that although the above description was written as applied to a piston-type engine, it is also applicable to other types of machines and mechanisms such as, for example, piston-type compressors.

While the best mode for carrying out the invention has been described in detail, those familiar with the art to which this invention relates will recognize various alternative designs and embodiments for practicing the invention as defined by the following claims

We claim:

1. A variable displacement engine comprising:

an engine block having a crank axis and a cylinder bore lying in a plane generally perpendicular to the crank axis;

a piston sealing cooperating with a cylinder bore for a reciprocal movement therein;

a crankshaft supported by the engine block and rotatable about the crank axis, said crankshaft having a crank pin radially spaced from said crank axis;

an elongated connected rod having a first end pivotably attached to the piston and a second end spaced therefrom movable along an arcuate path lying in said plane;

a lever having a fixed end pivotably attached to the block and a free end movable within said plane, said lever cooperating with the connecting rod second end to permit relative rotation and limited translation along a first path and cooperating with the crank pin to permit relative rotation and limited translation along a second path;

a link having a fixed end and a free end, one said link end being pivotably connected to the block and the other said link end being pivotably connected to the connecting rod second end; and adjustment means for adjusting the length of the link relative to the lever to vary the reciprocal stroke of the piston in order to vary engine displacement.

2. The invention of claim 1 wherein said lever is a plate member, said plate member being disposed within said plane and including a first elongated slot defining a guide surface along said first path;

said second end of the connecting rod being secured within the first elongated slot and adapted to slide along said guide surface from a top dead center piston position to a bottom dead center piston position.

3. The invention of claim 2 wherein said adjustment means includes means for adjusting the position of the second end of the connecting rod within said elongated slot.

4. The invention of claim 3 wherein the fixed end of the link is pivotally connected to the block and the free end of the link is pivotally connected to the connecting rod second end.

5. The invention of claim 1 wherein said adjustment means includes a hydraulic control cylinder having a housing and a hydraulic piston member reciprocable within the housing, said hydraulic piston member and housing defining a first hydraulic chamber on one side of said hydraulic piston member and a second chamber on the other side of said piston;

said link being connected to one of the housing and hydraulic piston members; and fluid transfer means for transferring fluid under pressure from one chamber to the other to thereby adjust the length of said link relative to said fixed end and thus to the lever.

6. The invention of claim 5 wherein said fluid transfer means includes first and second hydraulic lines extending between the two chambers, a valve member within one said hydraulic line and hydraulically coupled to one said chamber, a first check valve member interposed in said one hydraulic line between said first valve member and the other said chamber, said first check valve member being normally closed and automatically open to the flow of fluid under pressure from said one chamber to the other;

a second valve member within the other said hydraulic line and hydraulically coupled to the other chamber, a second check valve member interposed in said one hydraulic line between said second valve member and the one said chamber, said second check valve member being normally closed and automatically open to the flow of fluid under pressure from the other said chamber to the one said chamber.

7. The invention of claim 6 further including a fluid reservoir for providing fluid under pressure to said adjustment means and for providing a sump for fluid discharged from one of said two chambers.

8. The invention of claim 6, further including control means for selectively opening and closing each of said valve members to cause said hydraulic piston member to translate within the housing.

9. A variable displacement internal combustion engine comprising:

an engine block having a crank axis and a cylinder bore lying in a plane generally perpendicular to the crank axis;

a piston sealing cooperating with a cylinder bore for a reciprocal movement therein;

a crankshaft supported by the engine block and rotatable about the crank axis, said crankshaft having a crank pin radially spaced from said crank axis;

an elongated connected rod having a first end pivotably attached to the piston and a second end spaced therefrom movable along an arcuate path lying in said plane;

a lever having a fixed end pivotably attached to the block and a free end movable within said plane, said lever cooperating with the connecting rod second end to permit relative rotation and limited translation along a first path and cooperating with the crank pin to permit relative rotation and limited translation along a second path;

a link having a fixed end and a free end, one said link end being pivotably connected to the block and the other said link end being pivotably connected to the connecting rod second end; and adjustment means for adjusting the length of the link relative to the lever to vary the reciprocal stroke of the piston in order to vary engine displacement.

10. The invention of claim 9 wherein said lever being a plate member, said plate member being disposed within said plane and including a first elongated slot defining a guide surface along said first path;

said second end of the connecting rod being secured within the first elongated slot and adapted to slide along said guide surface from a top dead center piston position to a bottom dead center piston position.

11. The invention of claim 10 wherein said adjustment means includes a hydraulic control cylinder having a housing and a hydraulic piston member reciprocable within the housing, said hydraulic piston member and housing defining a first hydraulic chamber on one side of said hydraulic piston member and a second chamber on the other side of said piston;

said link being connected to one of the housing and hydraulic piston members; and fluid transfer means for transferring fluid under pressure from one chamber to the other to thereby adjust the length of said link relative to said fixed end and thus to the lever.

12. The invention of claim 11 further including a fluid reservoir for providing fluid under pressure to said adjustment means and for providing a sump for fluid discharged from one of said two chambers .

13. The invention of claim 12 wherein said fluid transfer means includes first and second hydraulic lines extending between the two chambers, a valve member within one said hydraulic line and hydraulically coupled to one said chamber, a first check valve member interposed in said one hydraulic line between said first valve member and the other said chamber, said first check valve mem[illegible]ng normally closed and automatically open to the flow of fluid under pressure from said one chamber to the other;

a second valve member within the other said hydraulic line and hydraulically coupled to the other chamber, a second check valve member interposed in said one hydraulic line between said second valve member and the one said chamber, said second check valve member being normally closed and automatically open to the flow of fluid under pressure from the other said chamber to the one said chamber.

14. The invention of claim 13 wherein said first and second valve members are solenoid actuated valves.

15. The invention of claim 14 wherein said fluid reservoir is common to the engine oil lubricating system.

16. The invention of claim 14- wherein said adjustment means includes a sensor for monitoring the distance the link travels in either direction when one of said valve members is opened to allow fluid flow between said two chambers, said sensor providing a feedback signal to said control means to arrest the travel of the hydraulic piston member at a prescribed location within the hydraulic housing.

* * * * *